US007971738B2

(12) United States Patent
DeJonge

(10) Patent No.: US 7,971,738 B2
(45) Date of Patent: Jul. 5, 2011

(54) ROTATE, SQUEEZE AND LIFT CHILD RESISTANT SAFETY CAP

(75) Inventor: Stuart W. DeJonge, DeLand, FL (US)

(73) Assignee: DeJonge Associates, Inc., Deland, FL (US)

( * ) Notice: Subject to any disclaimer, the term of this patent is extended or adjusted under 35 U.S.C. 154(b) by 755 days.

(21) Appl. No.: 12/082,317

(22) Filed: Apr. 10, 2008

(65) Prior Publication Data

US 2009/0255896 A1 Oct. 15, 2009

(51) Int. Cl.
*B65D 55/02* (2006.01)

(52) U.S. Cl. ..... 215/206; 215/220; 215/209; 215/221; 206/1.5

(58) Field of Classification Search ..... 215/206, 215/220, 209, 221; 206/1.5
See application file for complete search history.

(56) References Cited

U.S. PATENT DOCUMENTS

| | | | | | |
|---|---|---|---|---|---|
| 3,826,395 | A | * | 7/1974 | Montgomery | 215/221 |
| 3,843,007 | A | * | 10/1974 | Meyer | 215/206 |
| 3,881,624 | A | * | 5/1975 | Dougherty, Sr. | 215/221 |
| 4,080,441 | A | | 3/1978 | Gaffar et al. | |
| 4,224,307 | A | | 9/1980 | Thiele et al. | |
| 4,335,823 | A | * | 6/1982 | Montgomery et al. | 215/206 |
| 4,472,373 | A | | 9/1984 | Ryan | |
| 4,789,057 | A | * | 12/1988 | Fisher | 206/1.5 |
| 5,110,583 | A | | 5/1992 | Sampathkumar | |
| 5,562,218 | A | * | 10/1996 | Hamilton et al. | 215/221 |
| 5,849,311 | A | | 12/1998 | Sawan et al. | |
| 6,126,931 | A | | 10/2000 | Sawan et al. | |
| 6,161,711 | A | * | 12/2000 | Miceli et al. | 215/206 |
| 6,439,409 | B1 | * | 8/2002 | Dressel et al. | 215/228 |
| 6,450,352 | B1 | | 9/2002 | DeJonge | |
| 6,758,358 | B1 | * | 7/2004 | Bloom | 215/206 |

* cited by examiner

*Primary Examiner* — Anthony Stashick
*Assistant Examiner* — Kevin Castillo

(57) ABSTRACT

A squeeze and lift child resistant safety closure for attachment to a container having a conventional container closure on its top includes: an inner member for attachment to either the container or its closure, the inner member having an outer member interlocking component, being one of a circular track and a circular rail, the circular track having inside and outside ledges with a track space between the inside and outside ledges, the track space having a predetermined track space width, the circular rail having inside and outside protrusions adapted to ride inside the track space and under the ledges, the protrusions having widths less than the track space width and greater than one half the track space width; and an outer member being an outer closure having a circular bottom that is semi-flexible, and at its circular bottom, having the other of the one of a circular track and a circular rail. When the inner member is attached to a container under its conventional closure and the inner member and the outer member are interconnected, access to the convention closure is denied. However, if a user squeezes the outer member at the squeeze indicia to flex the outer member from circular to oval, the outer member can be removed to expose the conventional container closure for normal opening.

20 Claims, 9 Drawing Sheets

Figure 15
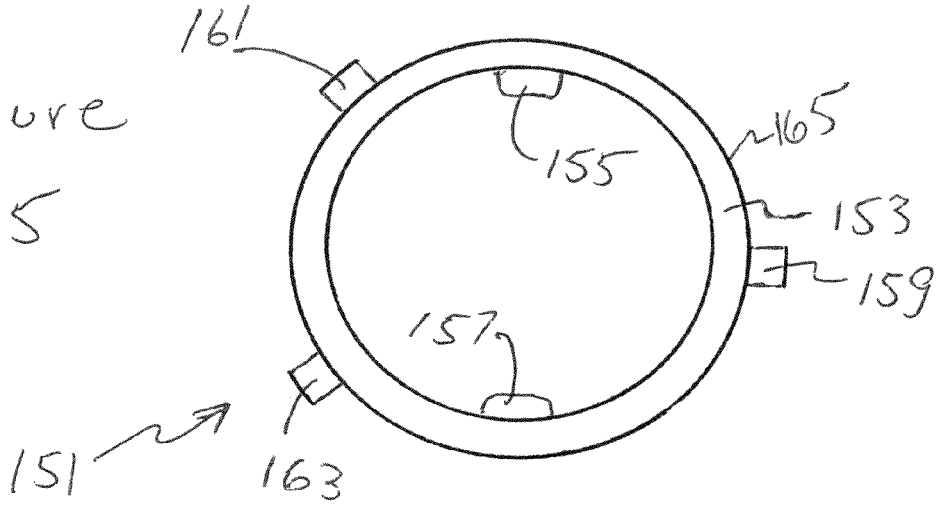
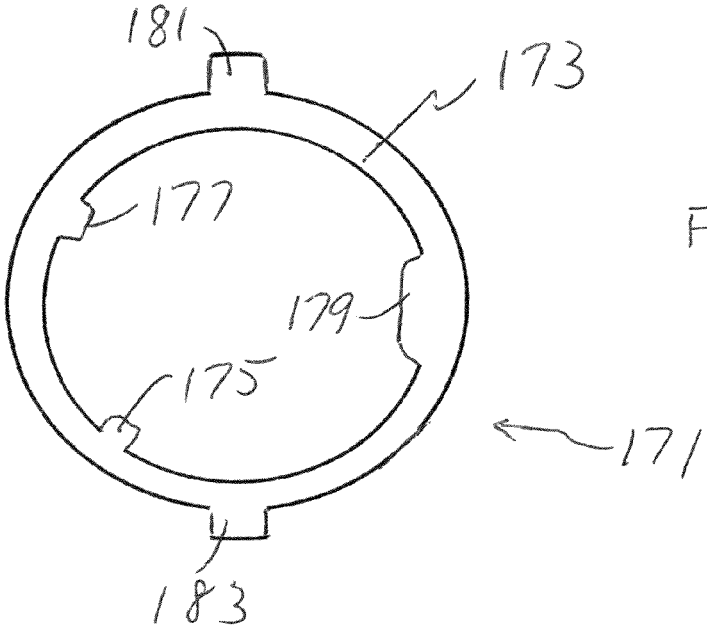
Figure 16

ROTATE, SQUEEZE AND LIFT CHILD RESISTANT SAFETY CAP

BACKGROUND OF INVENTION a. Field of Invention

The invention relates generally to a retrofitted child resistant safety cap that relies upon squeezing an outer member or inner member to flex it from a circle to an oval to permit removal or separation from one another to expose a conventional closure for use. Failure to position the thumb and first finger on the indicia and to squeeze, renders the safety cap child resistant. In some embodiments, there are indicia on both members and rotational alignment is required before proper squeezing to separate the two members from one another.

b. Description of Related Art

The following patents are representative of a log in system:

U.S. Pat. No. 6,450,352 B1 to DeJonge describes a present invention which is a child-resistant push and twist locking container. It includes a squeeze tube container having a neck and a dispensing orifice at an outer end of the neck, and the neck has one of a locking track and a locking lug. There is also a cap having at least three components and being assembled to cooperate with each other. This cap includes an outer shell having a sidewall and a top, the outer shell being adapted to receive and contain an inner top, a spring mechanism and an inner collar member; an inner top inserted into the outer shell and including a sealing liner for sealing the container and an inner collar member fixedly inserted into the outer shell and having the other of the locking track and the locking lug. There is a spring mechanism on at least one of the outer shell, the inner top and between the outer shell as a separate piece so as to permit the cap to be pushed and twisted into a closed side of the locking track wherein the spring mechanism biases the cap away from the container to maintain the lug in the track closed side.

U.S. Pat. No. 5,927,527 to Montgomery et al. describes the present closure and container combination which comprises a child resistant squeeze and turn closure having a tamper indicating band which is removed from the closure after the first removal of the closure from the container. The closure has dual squeeze pads located opposite one another on the outer wall of the closure. Formed at 90 degrees from the squeeze pads are two child resistant lugs which extend inwardly from the closure lower skirt wall. The child resistant lugs extend downwardly below the lowermost edge of the annular skirt of the closure. Frangible webs are positioned at 45 degrees from the external tabs and the squeeze pads and retain the tamper indicating band onto the closure side wall. A first and a second child resistant container lug contacts the closure lugs and are placed on the neck of the container above the tamper indicating bead. The child resistant feature of the closure needs to be overcome before the tamper indicating band is fractured from the closure. After removal of the tamper indicating band, the child resistant lugs extend below the closure side wall to provide a visual cue as to the child protective feature of the closure.

U.S. Pat. No. 5,687,863 to Kusz describes a squeeze and turn child resistant package including a container having a finish and a closure having a base wall and an outer peripheral flexible wall depending from the base wall. The wall has an internal thread on the inner surface thereof, the finish has an external thread thereon. The closure has an internal surface with spaced flexible chordal lugs extending circumferentially in the direction of removal of the closure. The container finish has opposed radially extending abutments. Each abutment includes a radial abutting surface. The finish of the container includes an intergral radial projection adjacent the radial abutting surface of the abutment which has a lesser radial extent than the abutment. The radial projection has a chordal surface extending to the intersection of the radial abutting surface on the finish such that the chordal lug on the closure is forced toward the intersection when a closure is rotated in a retrograde direction to remove the closure without flexing the peripheral wall. The finish has stops below the threads engaging a blunt end leading end of the thread on the closure to limit the movement of the closure and orient the closure.

U.S. Pat. No. 4,452,363 to Davis describes this invention which provides a tamper-resistant and child-resistant container and cap assembly in which a container body with a substantially cylindrical neck including an externally screw threaded portion near to the top and a plurality of lugs at the bottom, a cap with a cap body which tapers internally outwardly from an internally screw-threaded part near to the top and which has a corresponding number of depending webs near to the bottom for engagement with the lugs of the container body in the manner of a ratchet and pawl mechanism and a tamper-resistant band provided below the cap body and connected thereto by frangible tongues, the band being shaped to engage with the container body so that when the cap is unscrewed the cap body rises but the band is held down and the frangible tongues are broken.

U.S. Pat. No. 4,004,704 to Fernand Hilaire discloses a tamper-proof plastic closure device with safety means comprising and internally screw-threaded plug matching the screw-threaded and beaded neck of a container. The plug is retained by the neck bead engaging a groove formed in the outer skirt of the plug and the plug itself is covered by a cap in smooth frictional contact therewith. The central area of the internal surface of the flexible and bulged top wall the cap which is bounded by a rigid projecting circular rib, comprising means adapted to co-act with matching means provided in the central area of the plug when a sufficient pressure is exerted on the area, so as to rotatably drive the plug and release same from the retaining bead.

U.S. Pat. No. 3,749,270 to Lyle Claud Affleck describes an arrangement, for closing a container such as a bottle or like container, including a cap within the skirt of which is mounted one or more projections, for example, pins. Each pin fits into a groove formed in or on the neck or similar formation on the container. Each groove has at least one indent within which the inserted pin can be located to hold the cap in a position to seal the container. The cap is provided with means to bias it away from the container when the latter is sealed, and an enlarged indented section within a groove is used so that the biasing action in combination with the enlarged indented section provide a closure for the container which cannot be easily undone by young children. In another arrangement, the pins are located on the container and the grooves within the cap.

U.S. Pat. No. 3,733,001 to Peter Gach discloses a container and child proof closure therefor. The container has a neck surrounding an opening. At least two flanges project from the neck. Each flange has a spirally expanding first camming surface and downwardly directed helilcal second camming surface which terminates at an inwardly directed end surface. The closure comprises outer and inner members. The outer member includes lugs for engaging the second camming surface as the cap is rotated on the container neck to a locked position for holding the closure on the neck. The inner member includes resilient means which ride of the first camming surfaces and abut the flange end when the closure is to the locked position to prevent removal of the closure. Movement of the inner closure member against spring means within the outer closure member permits the closure to be rotated from the locked position for removal from the container. In one embodiment, means is provided for further tightening the closure on the container after it is in the locked portion.

U.S. Pat. No. 3,339,770 to Bruno Weigand describes in combination with a container provided with a mouth portion: a cap having a cylindrical side wall applicable to the mouth portion container, circumferentially-spaced side lugs carried by the cap on the inside thereof, climbing cams carried by the mouth of the container and peripherally disposed thereon for engagement by said lugs when the cap is turned in the closing direction to draw the cap down, recess means for engagement by the lugs to preclude the cap from turning in the opening direction, and tensionable means depending from said side wall for securing the lugs in the recess means, said tensionable means including an annular extension member in the vicinity of said mouth portion in the applied position of the container, said extension member having a resilient wall portion disposed to extend alongside of said mouth with a free edge curved outwardly therefrom for spreading under tension by contact with a relatively fixed surface when the cap is turned in its closing direction.

Notwithstanding the prior art, the present invention is neither taught nor rendered obvious thereby.

SUMMARY OF INVENTION

The present invention is, in one aspect, or first embodiment, a squeeze and lift child resistant safety closure for attachment to a container having a conventional container closure on its top that includes: an inner member having attachment means for attachment to the one of the container and the container closure, the inner member having an outer member interlocking component, being one of a circular track and a circular rail, the circular track having inside and outside ledges with a track space between the inside and outside ledges, the track space having a predetermined track space width, the circular rail having inside and outside protrusions adapted to ride inside the track space and under the ledges, the protrusions having widths less than the track space width and greater than one half the track space width; and an outer member being an outer closure having a circular bottom that is semi-flexible, and at its circular bottom, having the other of the one of a circular track and a circular rail, the circular track having inside and outside ledges with a track space between the inside and outside ledges, the track space having a predetermined track space width, the circular rail having inside and outside protrusions adapted to ride within the track space and under the ledges, the protrusions having widths greater than one half the track space width, and having squeeze indicia above the outside protrusions. In some cases, the width of the protrusions are less than the predetermined width of the track space, and in other cases, where there are cutouts, these protrusion widths may be greater than the width of the track space. When the inner member is attached to a container under its conventional closure and the inner member and the outer member are interconnected, a user cannot lift the outer member from the inner member nor lift the inner member from the container so that access to the conventional closure is denied. However, if a user squeezes the outer member at the squeeze indicia to flex the outer member from circular to oval, the outside protrusions are positioned inwardly to clear the ledges and the inside protrusions are positioned outwardly to clear the ledges so as to enable lift removal of the outer member from the inner member to expose the conventional container closure for normal opening.

In another aspect of the present invention, the squeeze and lift child resistant safety closure for attachment to a container having a conventional container closure on its top, includes: an inner member having a circular bottom that is semi-flexible, the inner member having attachment means for attachment to the one of the container and the container closure, the inner member having an outer member interlocking component at its circular bottom, being one of a circular track and a circular rail, the circular track having inside and outside ledges with a track space between the inside and outside ledges, the track space having a predetermined track space width, the circular rail having inside and outside protrusions adapted to ride inside the track space and under the ledges, the protrusions having widths greater than one half the track space width, and having squeeze indicia corresponding to the outside protrusions; and an outer member being an outer closure having a circular bottom, and at its circular bottom, having the other of the one of a circular track and a circular rail, the circular track having inside and outside ledges with a track space between the inside and outside ledges, the track space having a predetermined track space width, the circular rail having inside and outside protrusions adapted to ride within the track space and under the ledges, the protrusions having widths less than the track space width and greater than one half the track space width.

As in the first embodiment stated above, in this second embodiment, when the inner member is attached to a container under its conventional closure and the inner member and the outer member are interconnected, a user cannot lift the outer member from the inner member nor lift the inner member from the container so that access to the conventional closure is denied. However, if a user squeezes the inner member at the squeeze indicia to flex the inner member from circular to oval, the outside protrusions are positioned inwardly to clear the ledges and the inside protrusions are positioned outwardly to clear the ledges so as to enable lift removal of the outer member from the inner member to expose the conventional container closure for normal opening.

The concept of the invention involves squeezing either an inner member or an outer member to flex either the rail or the track to change its shape from a circle to an oval, so that there is relative movement between the track space and the rail protrusions to permit otherwise hindered removal of the outer member from the inner member to expose a conventional container closure for use. When one of the inner and outer members is properly squeezed, the outside protrusions are stated as positioned inwardly and conversely, the inside protrusions are stated as positioned outwardly. Thus, they are cleared from the confining ledges of the track. It should be noted, however, that the positioning may occur by squeezing one of the rail and the track and that actual movement may thus be either the track (ledge space) or the rail (protrusions) with the net result of the relative movement between the ledge space and the protrusions being the same. In other words it does not matter whether the protrusions are moved into the space or the space is moved to the protrusions—the relative positioning is the same.

In some preferred embodiments of the present invention squeeze and lift child resistant safety closure, the inner member and the outer member are circular from a top view.

In some preferred embodiments of the present invention squeeze and lift child resistant safety closure, there are two outside protrusions and two inside protrusions.

In some preferred embodiments of the present invention squeeze and lift child resistant safety closure, the protrusions are spaced equally apart from one another.

In some preferred embodiments of the present invention squeeze and lift child resistant safety closure, the protrusions are spaced equally apart from one another.

In some preferred embodiments of the present invention squeeze and lift child resistant safety closure, the attachment means is a riser and an inwardly projecting clamping component.

In some preferred embodiments of the present invention squeeze and lift child resistant safety closure, one of the ledges includes cutouts corresponding to at least one of the inside protrusions and the outside protrusions and both the inner member and the outer member have alignment means for rotation and alignment with one another to align the cutouts with their corresponding protrusions so as to clear at least one but not all of the protrusions prior to squeezing for lifting the outer member from the inner member.

In some preferred embodiments of the present invention squeeze and lift child resistant safety closure, the cutouts are located on the inside ledge and correspond to the inside protrusions.

In some preferred embodiments of the present invention squeeze and lift child resistant safety closure, the cutouts are located on the outside ledge and correspond to the outside protrusions.

In some preferred embodiments of the present invention squeeze and lift child resistant safety closure, at least one of the cutouts is located on the inside ledge and corresponds to at least one of the inside protrusions and wherein at least one of the cutouts is located on the outside ledge and corresponds to at least one of the outside protrusions.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIGS. 15 and 16 show top, cut views of alternative embodiments of outer or inner member rails with protrusions;

DETAILED DESCRIPTION OF THE EMBODIMENTS

Figure 1:
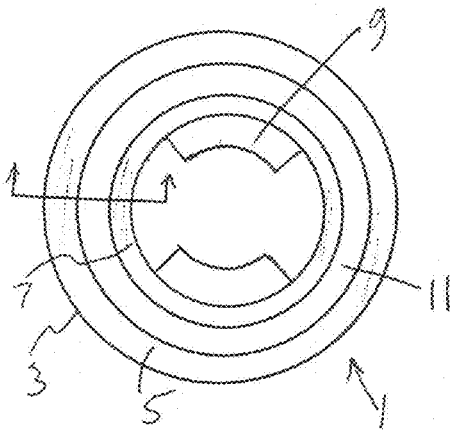
FIG. 1 shows a top view of a present invention squeeze and lift child resistant safety closure inner member and FIG. 2 shows a partial side view thereof.
Figure 2:
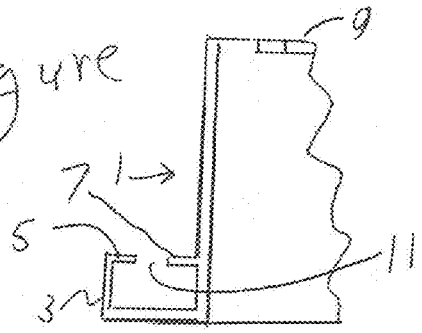

FIG. 1 shows a top view of a present invention squeeze and lift child resistant safety closure inner member 1 and FIG. 2 shows a partial side view thereof. Referring to both figures, inner member 1 includes a circular main body having attachment means, in this example, conventional container and closure-engaging flange, such as flange 9. Inner member 1 also has a track 3 with track outside ledge 5 and inside ledge 7, having a space therebetween. This space is rail-receiving space 11, adapted to receive and hold a rail of an outer member, in accordance with the present invention.

Figure 3:
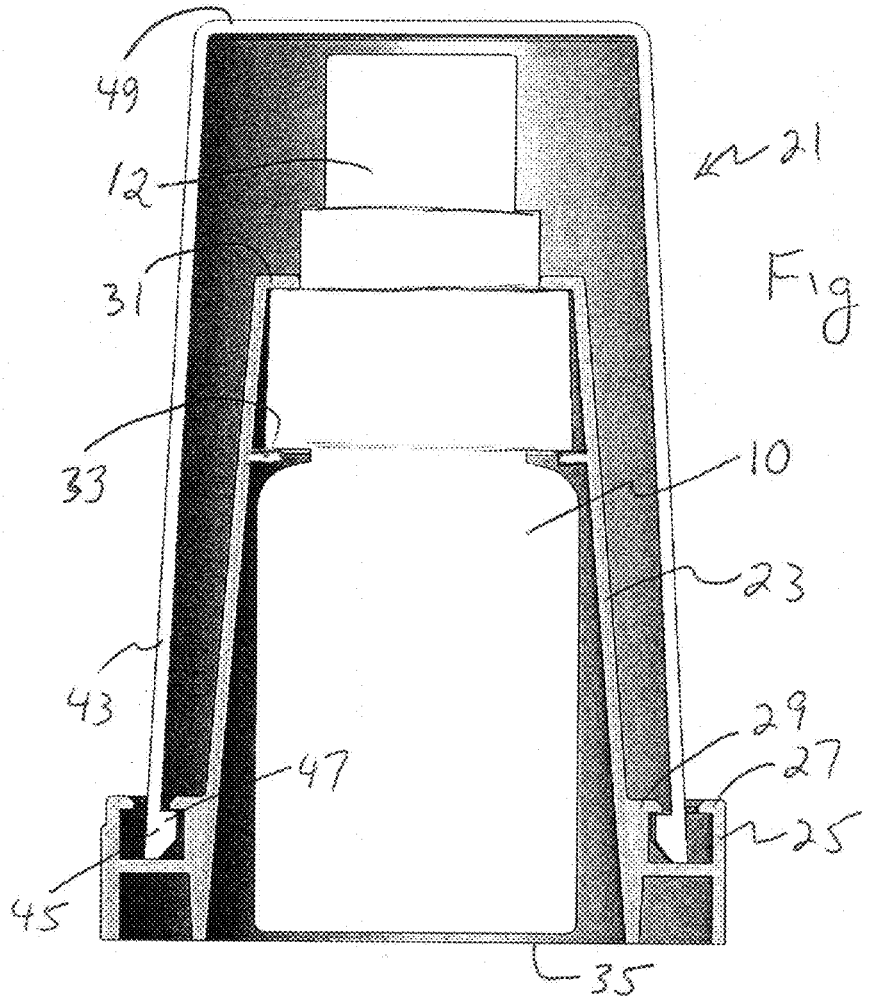
FIG. 3 shows a side cut view of a present invention squeeze and lift child resistant safety closure, including an inner member and an outer member, as well as a container with a conventional container closure.

FIG. 3 shows a side cut view of a present invention squeeze and lift child resistant safety closure 21, including an inner member 23 and an outer member 43, as well as a container 10 with a conventional container closure 12. Inner member 23 has container closure-engaging attachment flanges 31 and 33 to secure it to closure 12. Because inner member 23 has an open bottom 35, it is secured to container 10 and closure 12 by being force-fitted over them wherein flange 33 is compressed and pops under the bottom of closure 12 and, with flange 31, clamps inner member 23 to container 10 and closure 12. Near the bottom of inner member 23 is circular track 25 with outside ledge 27 and inside ledge 29 and an opening therebetween for receiving bottom rail 45 of outer member 43. Rail 45 has an inside protrusion 47 (inside because it is located on the inside of the outer member 43) that prevents its removal from inner member 23 unless it is stressed in a manner similar to that shown and discussed with respect to FIGS. 9 through 11 below. Because top 49 of outer member 43 is closed, a user cannot access closure 12 without first removing outer member 43. This is accomplished by squeezing outer member 43 at appropriately positioned indicia so as to deform the circular outer member 43 into an oval to remove outer member 43 and rail 45 from inner member 23.

Figure 4:
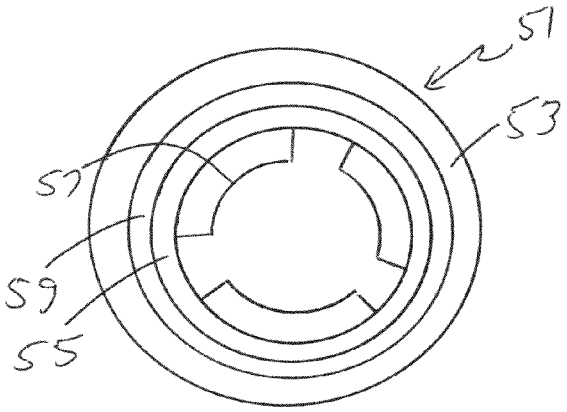
FIG. 4 shows top view of a another present invention squeeze and lift child resistant safety closure inner member.

FIG. 4 shows top view of another present invention squeeze and lift child resistant safety closure inner member 51. Inner member 51 is similar to inner member 1 in FIG. 1 described above except that it is specifically adapted to receive outer member 61 and its rail, shown in FIG. 5, and except that its attachment means is made of three flanges, such as flange 57. Inner member 51 has a track with outside ledge 53 and inside ledge 55. Between these track ledges is a space 59 that permits outer member 61 of FIG. 5 to be snapped into inner member 51.

Figure 5:
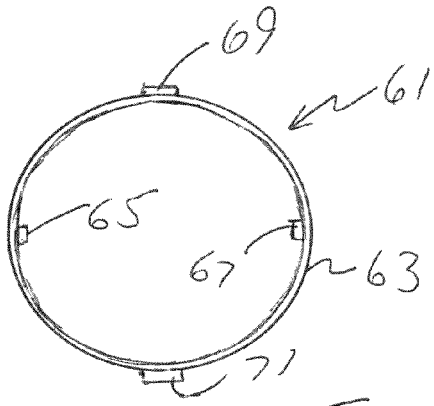
FIG. 5 shows a top view of a present invention squeeze and lift child resistant safety closure outer member that may be used in conjunction with, among others, the inner member shown in FIG. 4.

FIG. 5 shows a top view of a present invention squeeze and lift child resistant safety closure outer member 61 that may be used in conjunction with, among others, the inner member 51 shown in FIG. 4. Outer member 61 is shown with its top removed to reveal inside protrusions 65 and 67, along with outside protrusions 69 and 71.

Figure 6:
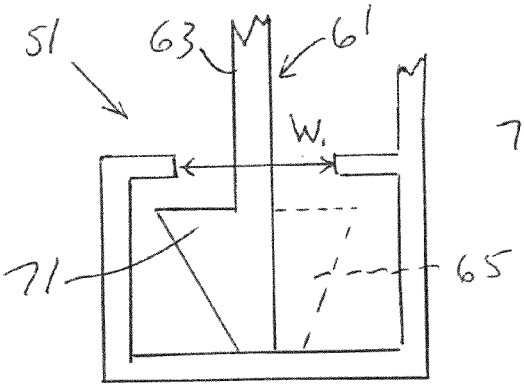
FIG. 6 shows a partial side cut view of the inner member shown in FIG. 4 with a partial cut side view of the outer member from FIG. 5 to illustrate the relative widths of the track space and the rail protrusions.
Figure 7:
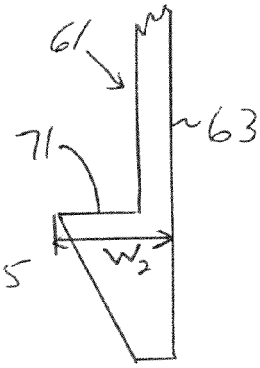
FIGS. 7 and 8 show partial cut side views of different parts of the present invention outer member shown in FIG. 5.
Figure 8:
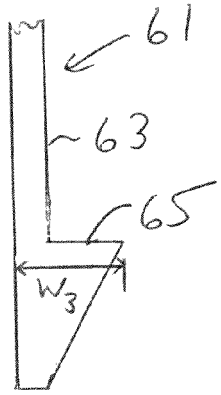
Figure 9:
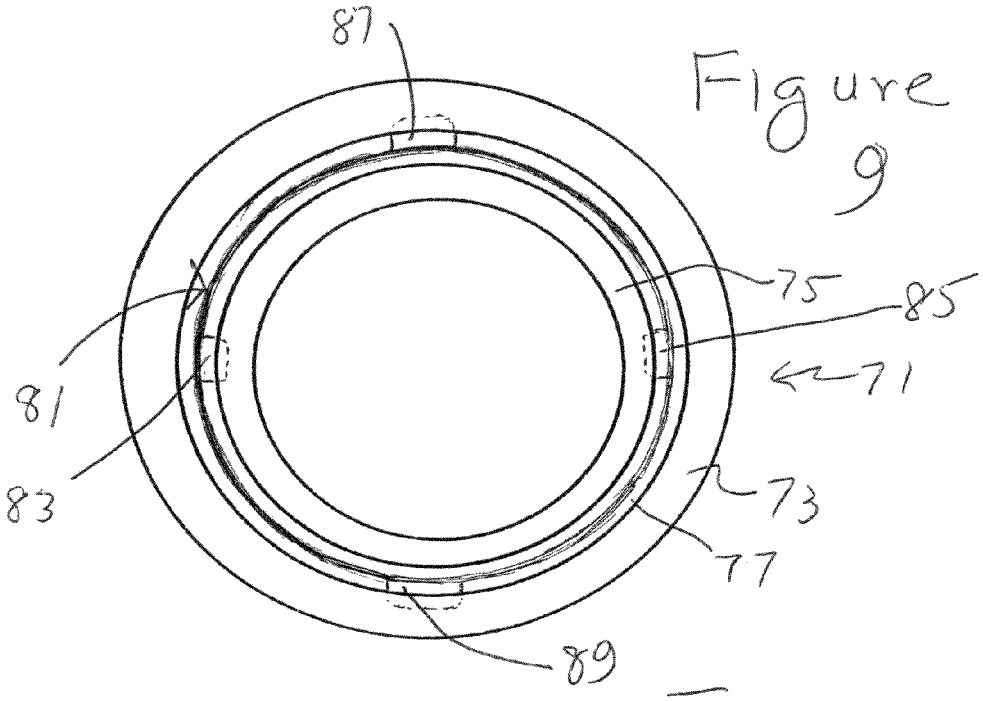
FIGS. 9, 10 and 11 show top, partial cut views with a present invention inner member and outer member interconnected, with a locked rest position shown in FIG. 9 and an unlocked, rail-squeezed flexed position shown in FIG. 10, and an unlocked, track-squeezed, flexed position shown in FIG. 11.
Figure 10:
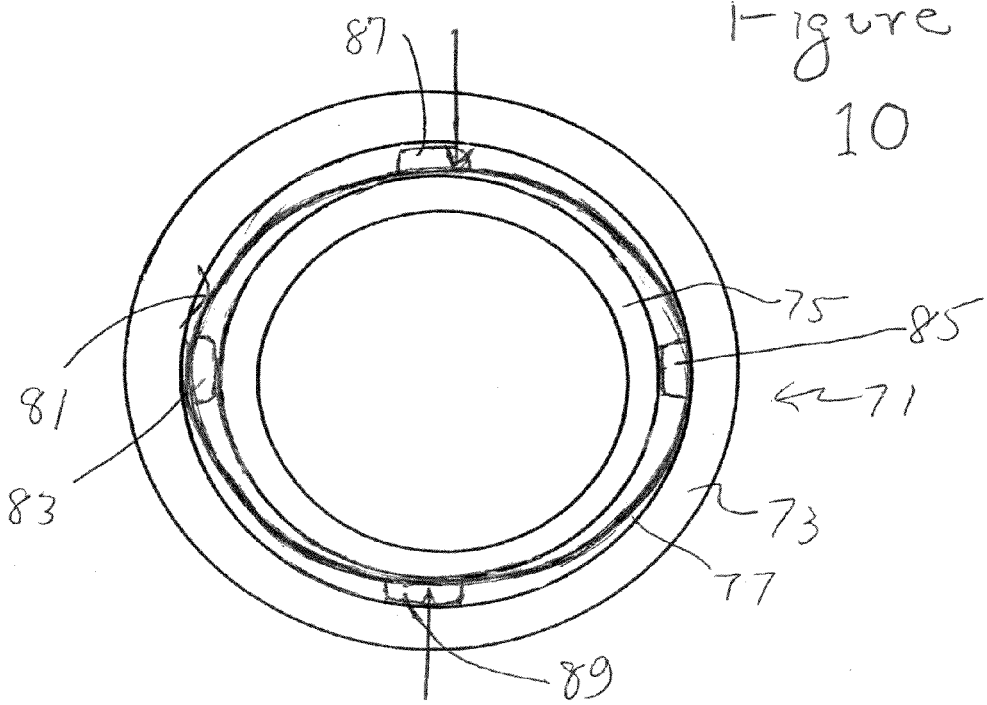
Figure 11:
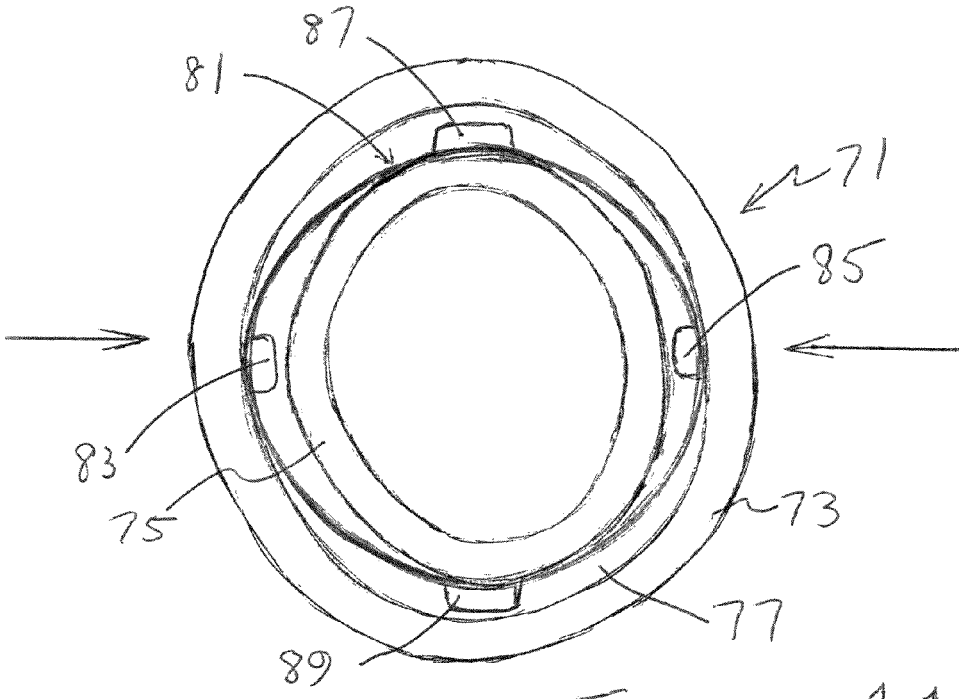

FIG. 6 shows a partial side cut view of the inner member 51 shown in FIG. 4 with a partial cut side view of the outer member 61 from FIG. 5 to illustrate the relative widths of the track space and the rail protrusions. As FIG. 6 shows, track 51 has an opening with a width $W_1$ that is wider than the width of protrusion 71. In some preferred embodiments including the example shown in these Figures, rail protrusion 71 has a width greater than one half of the track space width $W_1$, but less than the track space width $W_1$. FIGS. 7 and 8 show partial cut side views of different parts of the present invention outer member 61 shown in FIG. 5. FIG. 7 shows outside protrusion 71 of outer member 61 with a maximum width of $W_2$ and FIG. 8 shows inside protrusion 65 with a maximum width of $W_3$. In these embodiments $W_2$ and $W_3$ are each greater than one half of $W_1$, but less than $W_1$. These relationships enable the protrusions to fit into the track space but then to not be able to be removed therefrom without squeezing distortion. FIG. 6 shows that when the inside protrusion 65 and the outside protrusion 71 are in their normal rest position, they cannot be pulled out of the track of inner member 51. FIGS. 9, 10 and 11, although directed to different embodiments, illustrate the two different ways that inner member 51 and outer member 61 could interact.

FIGS. 9, 10 and 11 show top, partial cut views with a present invention inner member 71 and outer member 81 interconnected, with a locked rest position shown in FIG. 9 and an unlocked, outer member (rail)-squeezed/flexed position shown in FIG. 10, and an unlocked, inner member (track)-squeezed/flexed position shown in FIG. 11. Inner member 71 is a rail with an outside ledge 73 and an inside ledge 75 with a rail-receiving space 77. Outer member 81 has a pair of inside protrusions 83 and 85 and a pair of outside protrusions 87 and 89. They are all symmetrical with respect to one another and are, therefore, evenly spaced. However, they could be slightly offset and still function in accordance with the present invention.

FIG. 9 shows that in its rest position (nothing squeezed or otherwise flexed), the inside protrusions 83 and 85 and the outside protrusions 87 and 89 are partially under the ledges to as to inhibit lifting removal of the outer member from the inner member. However, as shown in FIG. 10, if a user squeezes outer member 81 at indicia (not shown) above outside protrusions 87 and 89, this distorts the shape of outer member 81 into an oval so as to move outside protrusions 87 and 89 inwardly and inside protrusions 83 and 85 outwardly, so that they all will clear the track ledges and can be removed from inner member 71 to then permit the user access to the conventional closure of the container. Likewise, FIG. 11 shows the same device with inner member 71 and outer member 81, but with a different squeezing concept. Here, the user squeezes inner member 71 instead of outer member 81 to achieve the same relative positions of the rail protrusions and the track, for release of the outer member 81 from the inner member 71. It should now be recognized that either the inner member or the outer member or both of these may be semi-flexible enough to shift the protrusions into a release position. In addition, the invention may be embodied by products wherein the track is on the inside member and the rail is on the outside member, or wherein the track is on the outside member and the rail is on the inside member. The following figures further illustrate this point and other possible variations.

Figure 12:
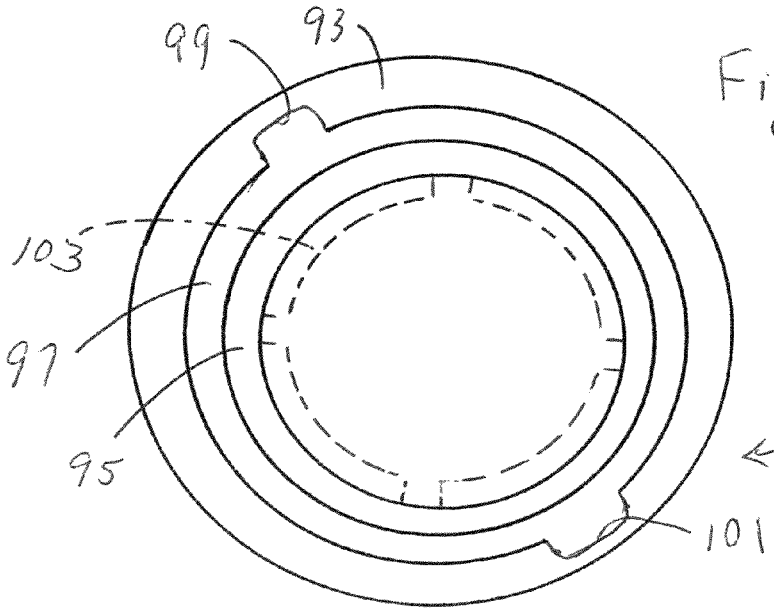
FIG. 12 shows a top view of another version of a present invention outer member or inner member track, but with outside ledge cutouts.

FIG. 12 shows a top view of another version of a present invention outer member or inner member 91 track, and this may face up on an inside member or face down on an outside member. FIG. 12 also illustrates another important variation of the present invention, namely, the track outside ledge has cutouts for alignment with protrusions. Member 91 includes a track with outside ledge 93 and inside ledge 95. Between these track ledges is a space 97 that permits insertion of a rail of the other member (not shown) to be snapped into member 91. (If member 91 were an inner member, it would also have attachment means for attachment to a conventional container and closure, such as flange 103. If member 91 were and outer member, it would have a slid or closed top.) Outside ledge 93 has two cutouts 99 and 101. In this version of the invention, the rail outside protrusions have a width sufficiently greater than half the width of space 97 such that the outside protrusions, even when squeezed and flexed, need to be in alignment with cutouts 99 and 101 to be removed. This requires two indicia, one on the outer member and the other on the inner member, that must be aligned to align the protrusions with the cutouts prior to squeezing, for opening.

Figure 13:
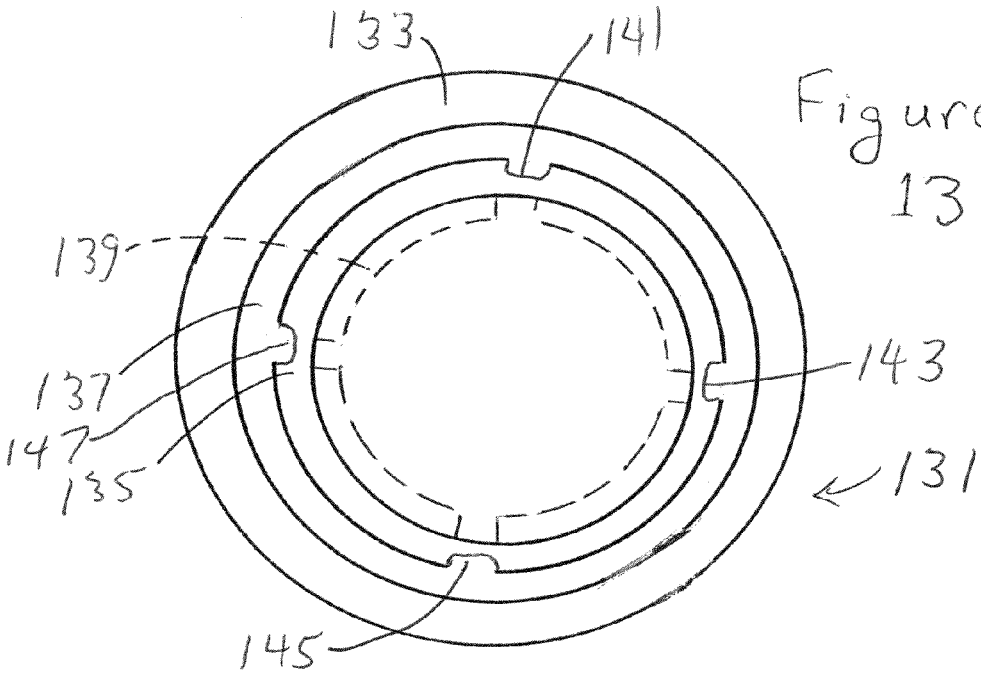
FIG. 13 shows a top view of another version of a present invention outer member or inner member track, but with inside ledge cutouts.

FIG. 13 also shows a top view of another version of a present invention outer member or inner member 131 having a track. The track may be located on the inner member or on the outer member, e.g., this may face up on an inside member or face down on an outside member. This figure also illustrates another important variation of the present invention, namely, its inside ledge has cutouts for alignment. Member 131 includes a track with outside ledge 133 and inside ledge 135. Between these track ledges is a space 137 that permits insertion of a rail of the other member (not shown) to be snapped into member 131. (If member 131 were an inner member, it would also have attachment means for attachment to a conventional container and closure, such as flange 139. If member 131 were and outer member, it would have a slid or closed top.) Outside ledge 133 has four cutouts 141, 143, 145 and 147. In this version of the invention, the rail inside protrusions have a width sufficiently greater than half the width of space 137 such that the inside protrusions, even when squeezed and flexed, need to be in alignment with cutouts 99 and 101 to be removed. This requires two indicia, one on the outer member and the other on the inner member, that must be aligned to align the protrusions with the cutouts prior to squeezing, for opening. In this embodiment, the alignment would render four inside protrusions releasable and the squeezing would shift other protrusions to releasable positions.

Figure 14:
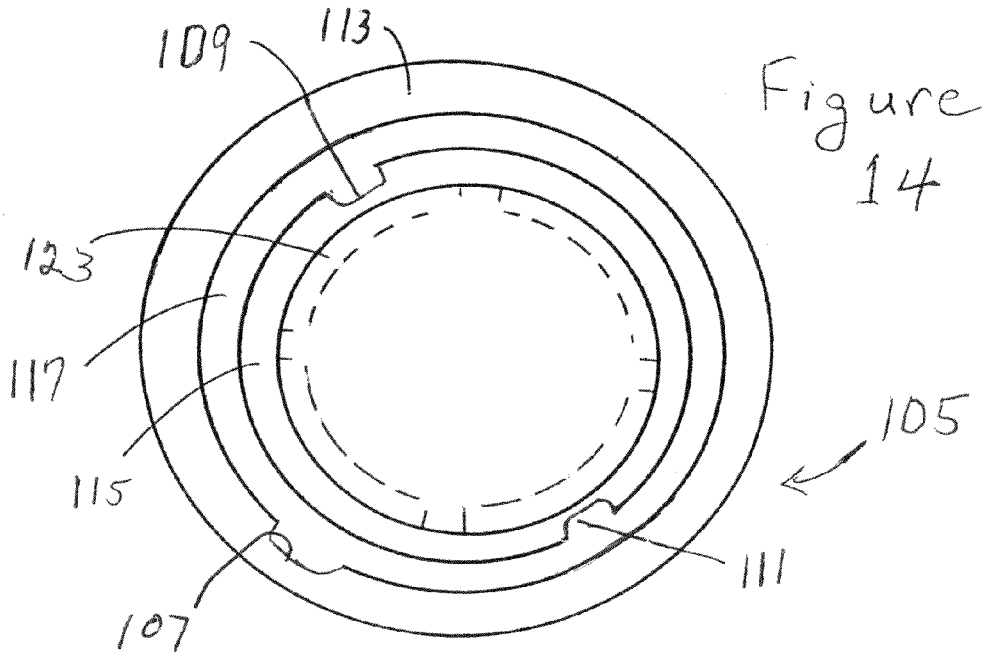
FIG. 14 shows a top view of yet another version of a present invention outer member or inner member track, but with inside ledge and outside ledge cutouts.

FIG. 14 also shows a top view of another version of a present invention outer member or inner member 105 having a track. The track may be located on the inner member or on the outer member, e.g., this may face up on an inside member or face down on an outside member. This figure also illustrates another important variation of the present invention, namely, both its inside ledge and its outside ledge may have one or more cutouts for corresponding protrusion alignment. Member 105 includes a track with outside ledge 113 and inside ledge 115. Between these track ledges is a space 117 that permits insertion of a rail of the other member (not shown) to be snapped into member 131. (If member 105 were an inner member, it would also have attachment means for attachment to a conventional container and closure, such as flange 123. If member 105 were and outer member, it would have a slid or closed top.) Outside ledge 113 has one cutout 141, and inside ledge 115 has two cutouts 109 and 111. In this version of the invention, a correspondingly positioned rail inside protrusion and two correspondingly positioned rail outside protrusions have a width sufficiently greater than half the width of space 117 such that these particular protrusions, even when squeezed and flexed, need to be in alignment with the corresponding cutouts to be removed. This requires two indicia, one on the outer member and the other on the inner member, that must be aligned to align the protrusions with the cutouts prior to squeezing, for opening. In this embodiment, alignment would render the corresponding inside and outside protrusions releasable and the squeezing would shift other protrusions to releasable positions.

FIGS. 15 and 16 show top, cut views of alternative embodiments of outer or inner member rails with protrusions, some that would be used for release by squeezing and some alignment, requiring both alignment and squeezing to open the outer member from the inner member. In FIG. 15, the rail member 151 has outside protrusions 159, 161 and 163 and inside protrusions 155 and 157. The outside protrusions are set up for alignment with cutouts for release, while the inside protrusions are directly opposing and set up for squeeze flexing for release. Alternatively, the inside protrusions or both inside or outside protrusions could be set up for cutout alignment or both cutout alignment and squeeze release. For example, in FIG. 16, the rail member 171 has outside protrusions 181 and 183 and inside protrusions 175, 177 and 179. The inside protrusions are set up for alignment with cutouts for release, while the outside protrusions are directly opposing and set up for squeeze flexing for release. In addition, ratchet, serration or other friction-engaging surfaces may be employed in the track and rail to inhibit free movement of the two relative to one another. In these embodiments, alignment movement will include overcoming the friction engagement.

Figure 17:
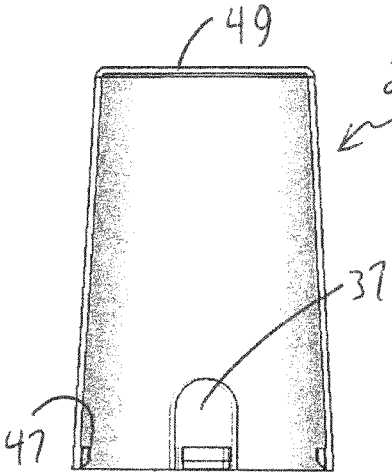
FIGS. 17, 18 and 19 show full side views of the outer member, inner member and the container with closure shown above in FIG. 3.
Figure 18:
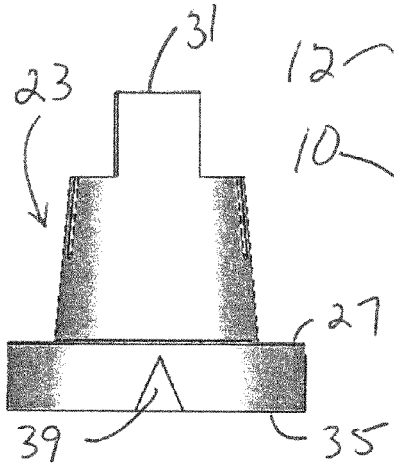
Figure 19:
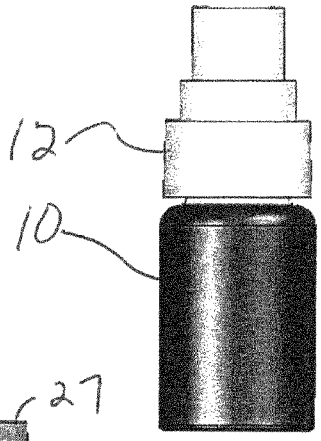
Figure 20:
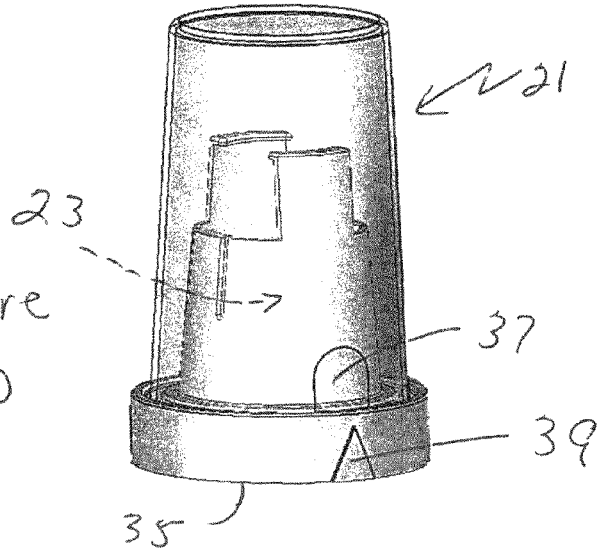
FIG. 20 shows the outer member and inner member of FIGS. 17 and 18 assembled.
Figure 21:
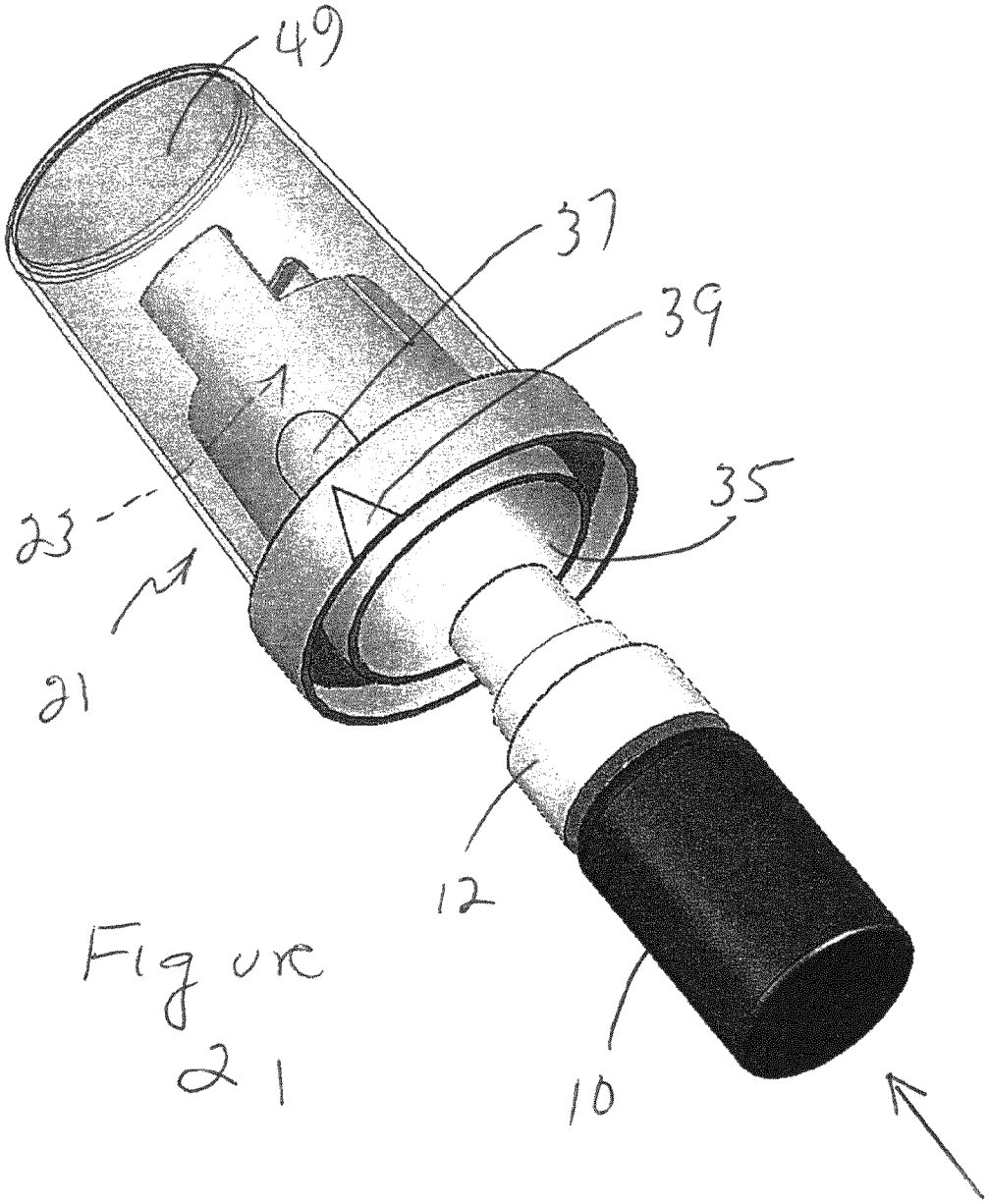
FIG. 21 shows insertion of the container and conventional closure of FIG. 19 being inserted into the assemblage shown in FIG. 20; and, FIGS. 22, 23 and 24 show 45 degree rotated oblique, side and front views of the completed assemblage shown in FIG. 21.

FIGS. 17, 18 and 19 show full side views of the outer member 21, inner member 23 and the container 10 with closure 12 shown above in FIG. 3, respectively. In FIG. 17, outer member 21 includes a closed top 49, and a rail with protrusions, such as inside protrusion 47, and an indicia 37. In FIG. 18, inner member 23 includes an open bottom 35, a track with ledges as shown in FIG. 3, such as outside ledge 27, attachment flange 31 and indicia 39. FIG. 20 shows the outer member 21 and inner member 23 of FIGS. 17 and 18 assembled together in a locking, rest position. FIG. 21 shows insertion of the container 10 and conventional closure 12 of FIG. 19 being inserted into the assemblage shown in FIG. 20, with identical components being identically numbered.

Figure 24:
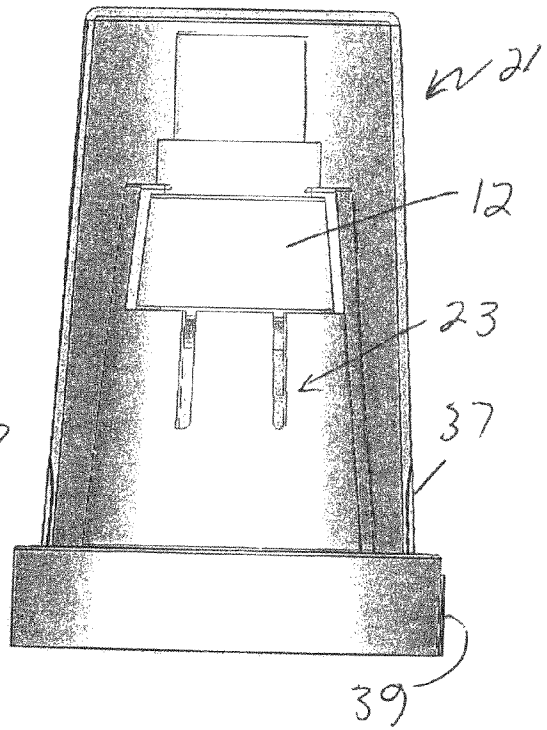
Figure 23:
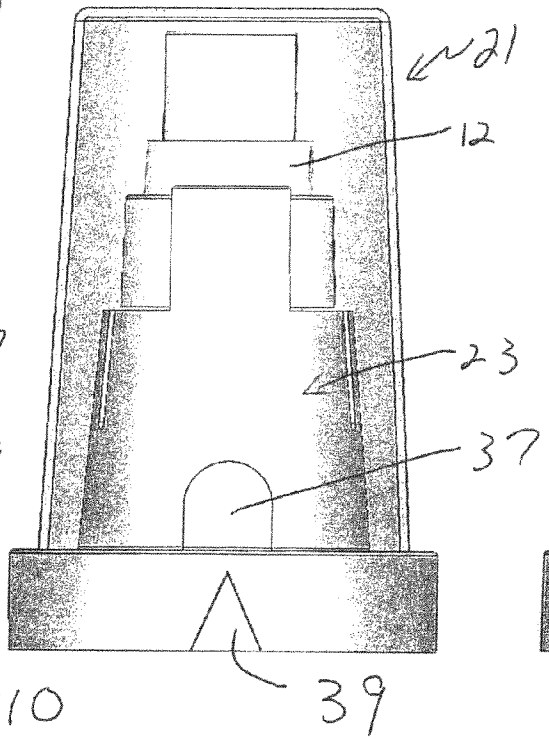
Figure 22:
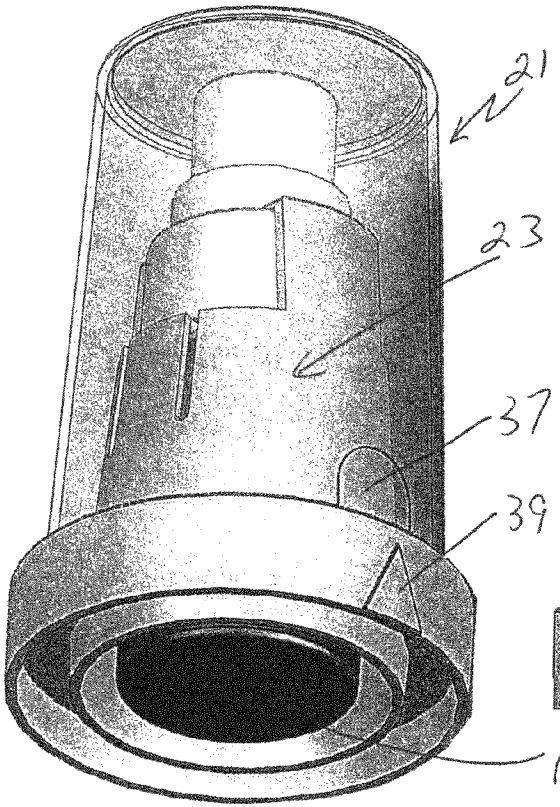

FIGS. 22, 23 and 24 show 45 degree rotated oblique, side and front views respectively, of the completed assemblage shown in FIG. 21, with identical components being identically numbered. Thus, referring to all three figures, outer member 21 is locked into inner member 23 and inner member 23 is locked onto container 10 with conventional closure 12. Unless an alignment of indicia 37 and 39 with the appropriate squeeze and lift effort, a user will be unable to access conventional container closure 12 for opening.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims. For example, it should be understood that the present invention is described for use with the container and conventional closure. The phrase "conventional closure" should be construed broadly to constitute any component that caps off the top of a container. In this context, a conventional closure could be a screw cap, a snap cap, a flip cap, any other lid or closure, a push-pull cap, an aerosol actuator, a sprayer, a pump or a nozzle.

What is claimed is:

1. A squeeze and lift child resistant safety closure for attachment to a container having a conventional container closure on its top, comprising:

an inner member having attachment means for attachment to said one of said container and said container closure, said inner member having an outer member interlocking component, being one of a circular track and a circular rail, said circular track having inside and outside ledges with a track space between said inside and outside ledges, said track space having a predetermined track space width, said circular rail having inside and outside protrusions adapted to ride inside said track space and under said ledges, said protrusions having widths greater than one half said track space width;

an outer member being an outer closure having a circular bottom that is semi-flexible, and at its circular bottom, having the other of said one of a circular track and a circular rail, said circular track having inside and outside ledges with a track space between said inside and outside ledges, said track space having a predetermined track space width, said circular rail having inside and outside protrusions adapted to ride within said track space and under said ledges, said protrusions having widths greater than one half said track space width, and having squeeze indicia above said outside protrusions;

wherein, when said inner member is attached to a container under its conventional closure and said inner member and said outer member are interconnected, a user cannot lift said outer member from said inner member nor lift said inner member from said container so that access to said conventional closure is denied, except, if a user squeezes said outer member at said squeeze indicia to flex said outer member from circular to oval, said outside protrusions are positioned inwardly to clear said ledges and said inside protrusions are positioned outwardly to clear said ledges so as to enable lift removal of said outer member from said inner member to expose said conventional container closure for normal opening.

2. The squeeze and lift child resistant safety closure for attachment to a container having a conventional container closure on its top according to claim 1, wherein said inner member and said outer member are circular from a top view.

3. The squeeze and lift child resistant safety closure for attachment to a container having a conventional container closure on its top according to claim 1, wherein there are two outside protrusions and two inside protrusions.

4. The squeeze and lift child resistant safety closure for attachment to a container having a conventional container closure on its top according to claim 1, wherein said protrusions are spaced equally apart from one another.

5. The squeeze and lift child resistant safety closure for attachment to a container having a conventional container closure on its top according to claim 3, wherein said protrusions are spaced equally apart from one another.

6. The squeeze and lift child resistant safety closure for attachment to a container having a conventional container closure on its top according to claim 1, wherein said attachment means is a riser and an inwardly projecting clamping component.

7. The squeeze and lift child resistant safety closure for attachment to a container having a conventional container closure on its top according to claim 1, wherein one of said ledges includes cutouts corresponding to at least one of said inside protrusions and said outside protrusions and both said inner member and said outer member have alignment means for rotation and alignment with one another to align said cutouts with their corresponding protrusions so as to clear at least one but not all of said protrusions prior to squeezing for lifting said outer member from said inner member.

8. The squeeze and lift child resistant safety closure for attachment to a container having a conventional container closure on its top according to claim 7, wherein said cutouts are located on said inside ledge and correspond to said inside protrusions.

9. The squeeze and lift child resistant safety closure for attachment to a container having a conventional container closure on its top according to claim 7, wherein said cutouts are located on said outside ledge and correspond to said outside protrusions.

10. The squeeze and lift child resistant safety closure for attachment to a container having a conventional container closure on its top according to claim 7, wherein at least one of said cutouts is located on said inside ledge and corresponds to at least one of said inside protrusions and wherein at least one of said cutouts is located on said outside ledge and corresponds to at least one of said outside protrusions.

11. A squeeze and lift child resistant safety closure for attachment to a container having a conventional container closure on its top, comprising:

an inner member having a circular bottom that is semi-flexible, said inner member having attachment means for attachment to said one of said container and said container closure, said inner member having an outer member interlocking component at its circular bottom, being one of a circular track and a circular rail, said circular track having inside and outside ledges with a track space between said inside and outside ledges, said track space having a predetermined track space width, said circular rail having inside and outside protrusions adapted to ride inside said track space and under said ledges, said protrusions having widths greater than one half said track space width, and having squeeze indicia corresponding to said outside protrusions;

an outer member being an outer closure having a circular bottom, and at its circular bottom, having the other of said one of a circular track and a circular rail, said circular track having inside and outside ledges with a track space between said inside and outside ledges, said track space having a predetermined track space width, said circular rail having inside and outside protrusions adapted to ride within said track space and under said ledges, said protrusions having widths greater than one half said track space width;

wherein, when said inner member is attached to a container under its conventional closure and said inner member and said outer member are interconnected, a user cannot lift said outer member from said inner member nor lift said inner member from said container so that access to said convention closure is denied, except, if a user squeezes said inner member at said squeeze indicia to flex said inner member from circular to oval, said outside protrusions are positioned inwardly to clear said ledges and said inside protrusions are positioned outwardly to clear said ledges so as to enable lift removal of said outer member from said inner member to expose said conventional container closure for normal opening.

12. The squeeze and lift child resistant safety closure for attachment to a container having a conventional container closure on its top according to claim 11, wherein said inner member and said outer member are circular from a top view.

13. The squeeze and lift child resistant safety closure for attachment to a container having a conventional container closure on its top according to claim 11, wherein there are two outside protrusions and two inside protrusions.

14. The squeeze and lift child resistant safety closure for attachment to a container having a conventional container closure on its top according to claim 11, wherein said protrusions are spaced equally apart from one another.

15. The squeeze and lift child resistant safety closure for attachment to a container having a conventional container closure on its top according to claim 13, wherein said protrusions are spaced equally apart from one another.

16. The squeeze and lift child resistant safety closure for attachment to a container having a conventional container closure on its top according to claim 11, wherein said attachment means is a riser and an inwardly projecting clamping component.

17. The squeeze and lift child resistant safety closure for attachment to a container having a conventional container closure on its top according to claim 11, wherein one of said ledges includes cutouts corresponding to at least one of said inside protrusions and said outside protrusions and both said inner member and said outer member have alignment means for rotation and alignment with one another to align said cutouts with their corresponding protrusions so as to clear at least one but not all of said protrusions prior to squeezing for lifting said outer member from said inner member.

18. The squeeze and lift child resistant safety closure for attachment to a container having a conventional container closure on its top according to claim 17, wherein said cutouts are located on said inside ledge and correspond to said inside protrusions.

19. The squeeze and lift child resistant safety closure for attachment to a container having a conventional container closure on its top according to claim 17, wherein said cutouts are located on said outside ledge and correspond to said outside protrusions.

20. The squeeze and lift child resistant safety closure for attachment to a container having a conventional container closure on its top according to claim 17, wherein at least one of said cutouts is located on said inside ledge and corresponds to at least one of said inside protrusions and wherein at least one of said cutouts is located on said outside ledge and corresponds to at least one of said outside protrusions.

* * * * *